US007416154B2

(12) United States Patent
Bittle et al.

(10) Patent No.: US 7,416,154 B2
(45) Date of Patent: Aug. 26, 2008

(54) TRAJECTORY CORRECTION KIT

(75) Inventors: David A. Bittle, Somerville, AL (US); Gary T. Jimmerson, Athens, AL (US); Julian L. Cothran, Arab, AL (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 298 days.

(21) Appl. No.: 11/229,425

(22) Filed: Sep. 16, 2005

(65) Prior Publication Data

US 2007/0063095 A1 Mar. 22, 2007

(51) Int. Cl.
*F41G 7/00* (2006.01)
*F42B 15/01* (2006.01)
*F42B 15/00* (2006.01)

(52) U.S. Cl. ..... 244/3.22; 244/3.1; 244/3.15; 244/3.21

(58) Field of Classification Search ..... 244/3.1–3.3, 244/164, 169, 171; 60/228, 229
See application file for complete search history.

(56) References Cited

U.S. PATENT DOCUMENTS 3,802,190 A * 4/1974 Kaufmann ..... 244/3.22
4,408,735 A * 10/1983 Metz ..... 244/3.22
4,463,921 A * 8/1984 Metz ..... 244/3.22
4,482,107 A * 11/1984 Metz ..... 244/3.22
4,689,845 A * 9/1987 Stessen ..... 60/228
4,712,748 A * 12/1987 Schafer ..... 244/3.22
4,790,493 A * 12/1988 Schwarzkopf et al. ..... 244/3.21
4,844,380 A * 7/1989 Peoples et al. ..... 244/3.22
4,928,906 A * 5/1990 Sturm ..... 244/3.22
5,054,712 A * 10/1991 Bar et al. ..... 244/3.22
5,062,593 A * 11/1991 Goddard et al. ..... 244/169
5,123,611 A * 6/1992 Morgand ..... 244/3.22
5,129,604 A * 7/1992 Bagley ..... 244/3.22
5,259,569 A * 11/1993 Waymeyer et al. ..... 244/3.22
5,456,425 A * 10/1995 Morris et al. ..... 244/3.22
5,507,452 A * 4/1996 Mayersak ..... 244/3.15
5,657,947 A * 8/1997 Mayersak ..... 244/3.19
6,178,741 B1 * 1/2001 Nelson et al. ..... 244/3.22
6,254,031 B1 * 7/2001 Mayersak ..... 244/3.22

(Continued)

OTHER PUBLICATIONS

Thomas Drescher/"Rocket Trajectory Correction using Strap-on GPS Guided Thrusters"/Proceedings of IEEE, Position Location and Navigation Symposium/Apr. 20-23, 1998/pp. 387-394.

*Primary Examiner*—Bernarr E Gregory
(74) *Attorney, Agent, or Firm*—Hay Kyung Chang

(57) ABSTRACT

The Trajectory Correction Kit (TCK) is a completely self-contained retrofit kit that is externally and fixedly mounted as an add-on to the rear (aft of the tailfins) of an existing, unguided rocket. The TCK continuously measures the pitch and yaw of the rocket as it is released from the launch tube and during the initial seconds of the flight and calculates the trajectory correction that is necessary to eliminate the measured pitch and yaw. Then it activates selected thrusters among the thrusters that are positioned around the circumference of the rocket body so as to steer the rocket in a direction until the measured pitch and yaw are eliminated. This results in significant reductions in both the rocket flight path dispersion and collateral damage.

17 Claims, 6 Drawing Sheets

U.S. PATENT DOCUMENTS

| | | | | |
|---|---|---|---|---|
| 6,267,326 | B1 * | 7/2001 | Smith et al. | 244/3.22 |
| 6,347,763 | B1 * | 2/2002 | Harkins et al. | 244/3.21 |
| 6,367,735 | B1 * | 4/2002 | Folsom et al. | 244/3.22 |
| 6,629,668 | B1 * | 10/2003 | Grau et al. | 244/3.22 |
| 6,695,251 | B2 * | 2/2004 | Rodden et al. | 244/3.21 |
| 6,752,351 | B2 * | 6/2004 | John | 244/3.22 |
| 6,889,935 | B2 * | 5/2005 | O'Dwyer | 244/3.21 |
| 6,951,317 | B2 * | 10/2005 | Woessner et al. | 244/3.22 |
| 7,004,423 | B2 * | 2/2006 | Folsom et al. | 244/3.22 |
| 7,118,065 | B1 * | 10/2006 | Heitmann et al. | 244/3.22 |
| 2003/0197088 | A1 * | 10/2003 | Folsom et al. | 244/3.22 |
| 2004/0084564 | A1 * | 5/2004 | John | 244/3.22 |
| 2005/0103925 | A1 * | 5/2005 | Folsom et al. | 244/3.21 |

* cited by examiner

TRAJECTORY CORRECTION KIT

The invention described herein may be manufactured, used and licensed by or for the Government for U.S. governmental purposes; provisions of 15 U.S.C. section 3710c apply.

BACKGROUND OF THE INVENTION

Unguided artillery rockets, utilized for area suppression fire missions, are most vulnerable to trajectory perturbations during launch and the first several seconds of flight. The trajectory perturbations are manifested as dispersion of the rockets over the target area, with the result that many such rockets must be fired to ensure that the area of interest is sufficiently covered.

Efforts have been made to add low or medium cost guidance packages to such ballistic rockets to make them impact the selected target more accurately. One system, intended for small and short range rockets, included a semi-active laser seeker and canard guidance package for direct fire guidance all the way to the target. Another system, focusing on large indirect fire artillery rockets for longer ranges, utilized Global Positioning System inputs to an inertial measurement unit along with nose-mounted canards for trajectory control.

However, such efforts required the development of a new airframe for the rockets. Further, both systems placed the control actuators and the associated electronics in the nose of the weapon and controlled the trajectory all the way until target impact. Even though these systems rendered such rockets more accurate against point or very much smaller objects than area targets, neither system is suitable for use with the large stocks of unguided artillery rockets that are already in existence, because of the incompatibility with the rockets' airframe.

SUMMARY OF THE INVENTION

The Trajectory Correction Kit (TCK) is a completely self-contained retrofit kit that is externally and fixedly mounted onto the rear (aft of the tailfins) of the rocket. The TCK continuously measures the pitch and yaw of the rocket as it is released from the launch tube and during the initial seconds of the flight and corrects the initial flight path perturbations by firing selected thrusters to steer the rocket until the measured pitch and yaw are eliminated. This results in significant reductions in both the rocket flight path dispersion and collateral damage.

DESCRIPTION OF THE PREFERRED EMBODIMENT

Figure 1:
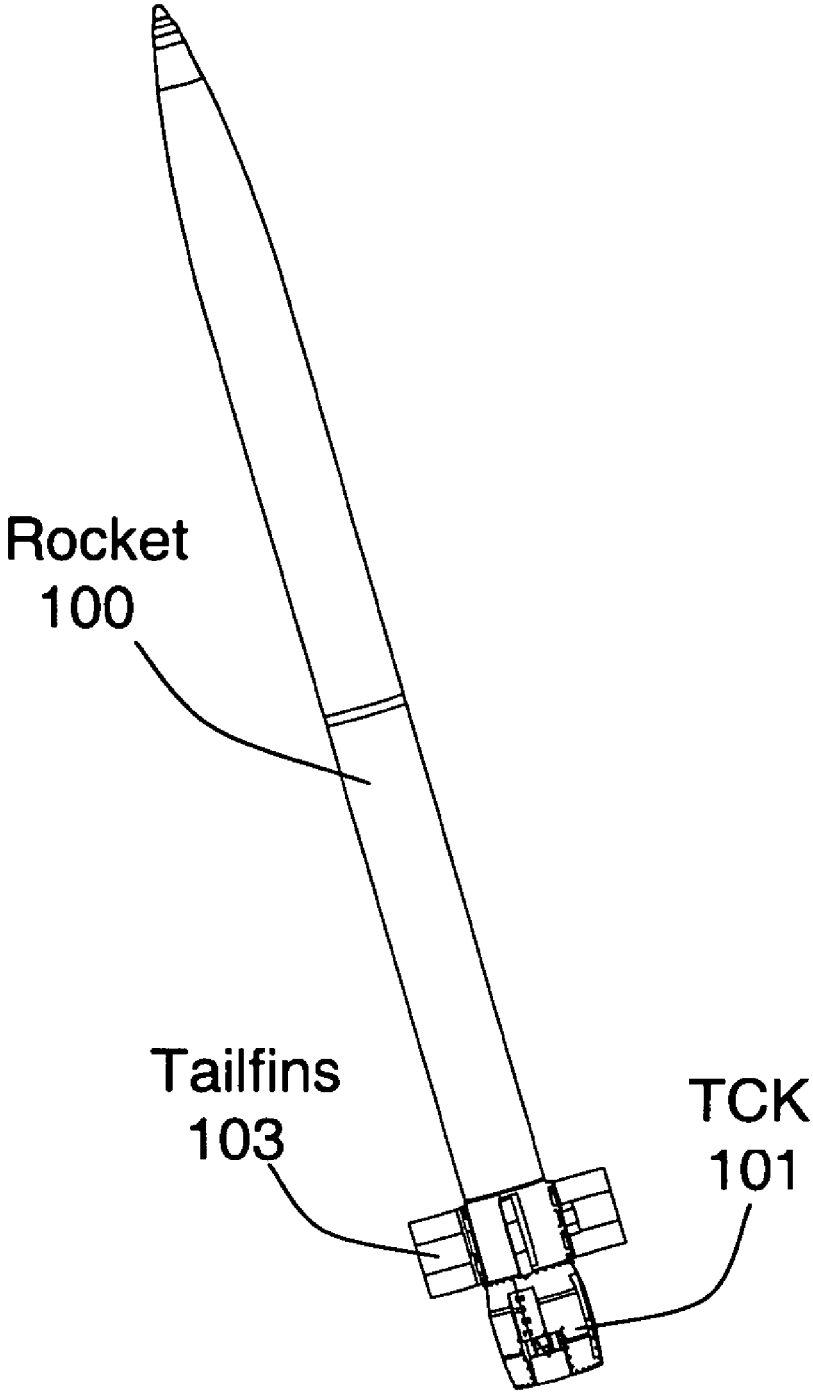
FIG. 1 illustrates the position of the trajectory correction kit on the rocket.

Referring now to the drawing wherein like numbers represent like parts in each of the several figures, the structure and operation of the trajectory correction kit (TCK) is described in detail.

Any and all of the numerical dimensions and values that follow should be taken as nominal values rather than absolutes or as a limitation on the scope of the invention. These nominal values are examples only; many variations in size, shape and types of materials may be used as will readily be appreciated by one skilled in the art as successfully as the values, dimensions and types of materials specifically set forth hereinafter. In this regard, where ranges are provided, these should be understood only as guides to the practice of this invention.

Free-flight rocket theory and practice have established that the most significant trajectory errors occur within the first few seconds of flight. The most significant error sources are launch-induced errors and aerodynamic effects that occur before the rocket fins deploy and before the rocket velocity is sufficient to generate aerodynamic stability. TCK corrects these errors immediately, whereas the canard type guidance systems, such as previously available, must allow the rocket velocity to build before corrections become effective. Consequently, using canard systems makes the magnitude and duration of the necessary correction larger. Additionally, the canard correction system significantly alters the aerodynamics of the rocket and usually necessitates new firing algorithms for the rocket. In contrast, as will be seen below, the thin cross section of the TCK and its aerodynamic housing has minimal effect on the drag of the rocket on which it is mounted, thus enabling the rocket's original firing algorithm to be used with little or no modification.

TCK 101 is intended to be installed on the rear (aft of tailfins 103) of rocket 100 so the TCK can be partially aerodynamically obscured by the tailfins. The TCK, which is essentially a tube having an annular vertical cross section, is mounted onto the rocket by being slipped over the rear portion of the rocket body so as to wrap around the rear portion. This is illustrated in FIG. 1. The specific mechanism for mounting the TCK so as to secure its attachment fixedly to the rocket prior to and during flight depends on the shape of the airframe of the particular rocket on which it is used.

Figure 2:
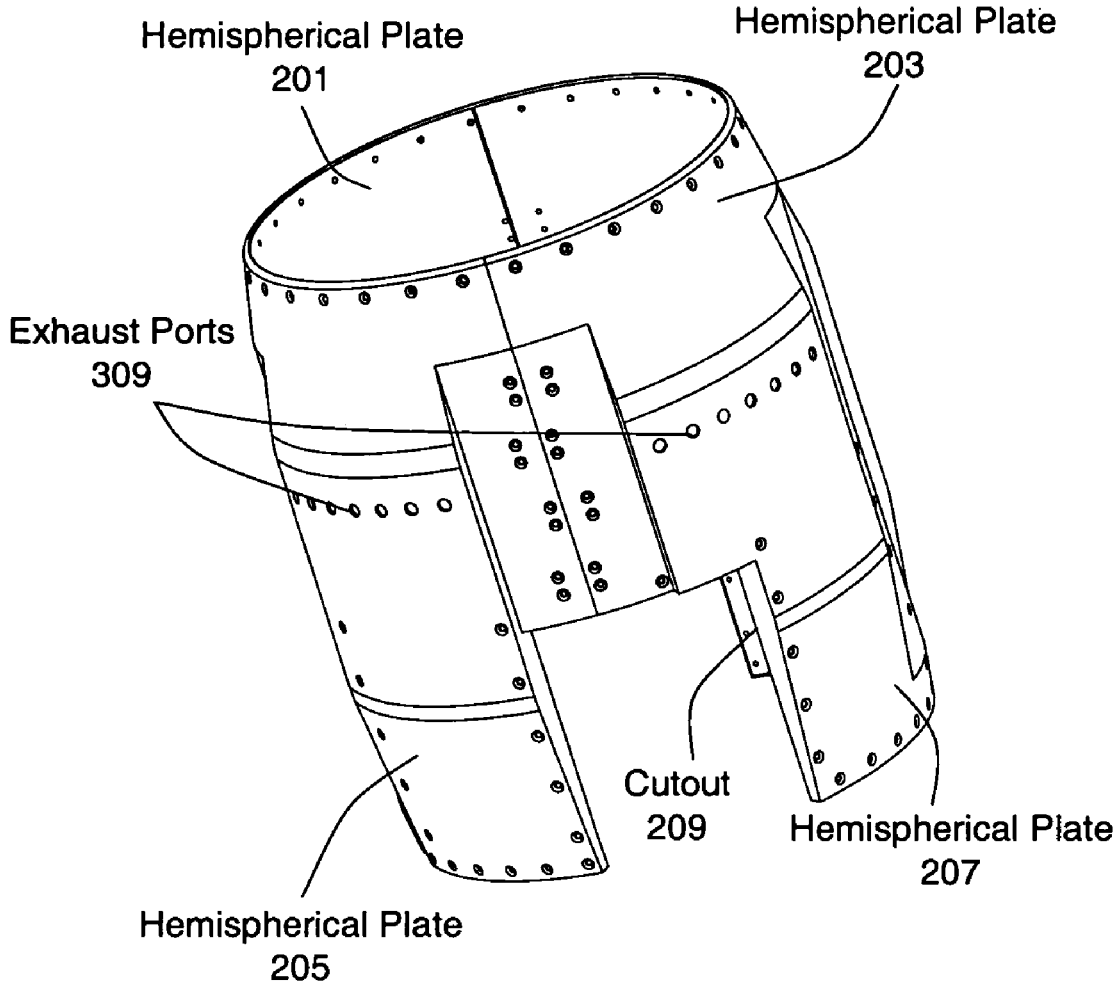
FIG. 2 shows the housing and the overall shape of the TCK.

One such securing mechanism is explained with respect to the Multiple Launch Rocket System (MLRS) rocket. The general configuration of the MLRS is shown in FIG. 1 and the external configuration of the TCK is shown in FIG. 2. The MLRS has protruding spin lugs on its outer body. To accommodate and take advantage of this feature on an already-existing rocket, cut-outs 209 that match the shape and size of the lugs can be made into the housing of the TCK. The TCK is positioned on the rocket immediately in front of the lugs, with the lugs slipping into the cut-outs. Such mounting allows the lugs to keep the TCK from falling off the rocket and also to prevent the TCK from sliding around the rocket body during flight.

Other suitable mounting mechanisms may be found for extant rockets that accommodate the unique airframes of the rockets. For rockets yet to be produced, the TCK can be integrated into the airframe during manufacture or internalized and placed in the payload bay or the nose.

Figure 5:
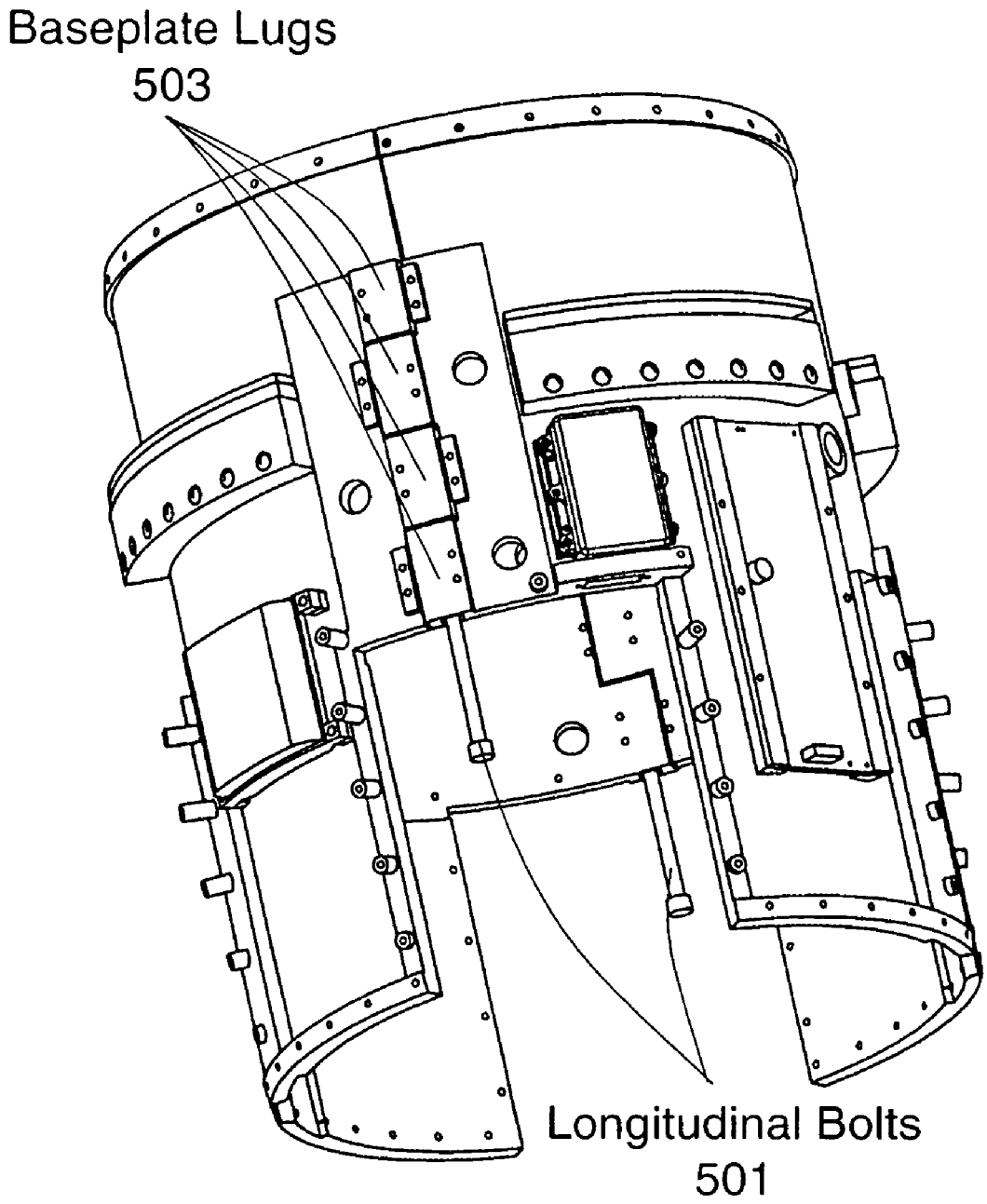
FIG. 5 illustrates how the hemispherical plates are joined together.

As seen further in FIG. 2, for it to be usable as an external add-on to a pre-existing rocket (such as an MLRS that has protruding spin lugs) and for ease of installation, the TCK can be comprised of first and second hemispherical plates 201 and 203 that are joined together to form a complete ring (tubular unit) around the rocket. They may be joined by longitudinal bolts 501 that slide through the holes in plate lugs 503. This, illustrated in FIG. 5, is basically a door hinge type arrangement. Another means for adjoinment is a lap joint that screws the plates together. Yet another means is using high-strength aerospace fasteners in a cross bolt arrangement.

If the TCK is to be installed on the rocket during the manufacturing process, the plates may be formed as a single, integrated unit.

Over the first and second hemispherical plates and sharing the same design, including any necessary cut-outs, third and fourth hemispherical plates 205 and 207 can be added to serve as aerodynamic covers. The third and fourth plates together form an annulus and are joined to the first and second plates, respectively, using any suitable aerospace fastening means.

Due to the high temperature environment of the artillery rocket launch tube, suitable materials for the TCK plates are aluminum, stainless steel or non-metallic materials that are capable of withstanding high temperatures.

Figure 3:
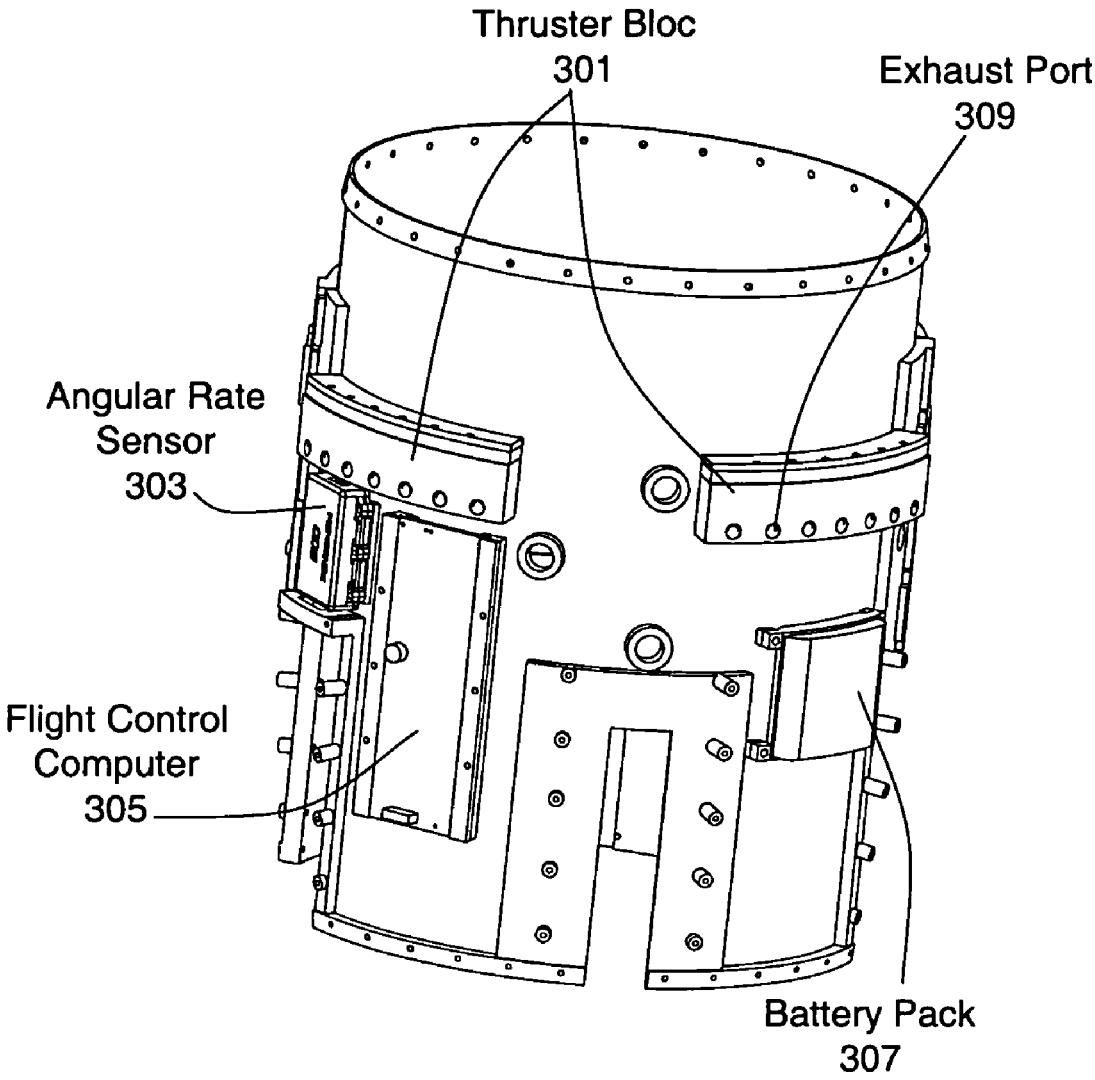
FIG. 3 depicts first hemispherical plate and the components thereon.

FIG. 3 shows the TCK with the aerodynamic covers removed. Onto the first hemispherical plate are secured first battery pack 307, angular rate sensor 303, flight control computer 305 and a multitude of thrusters 301.

Figure 4:
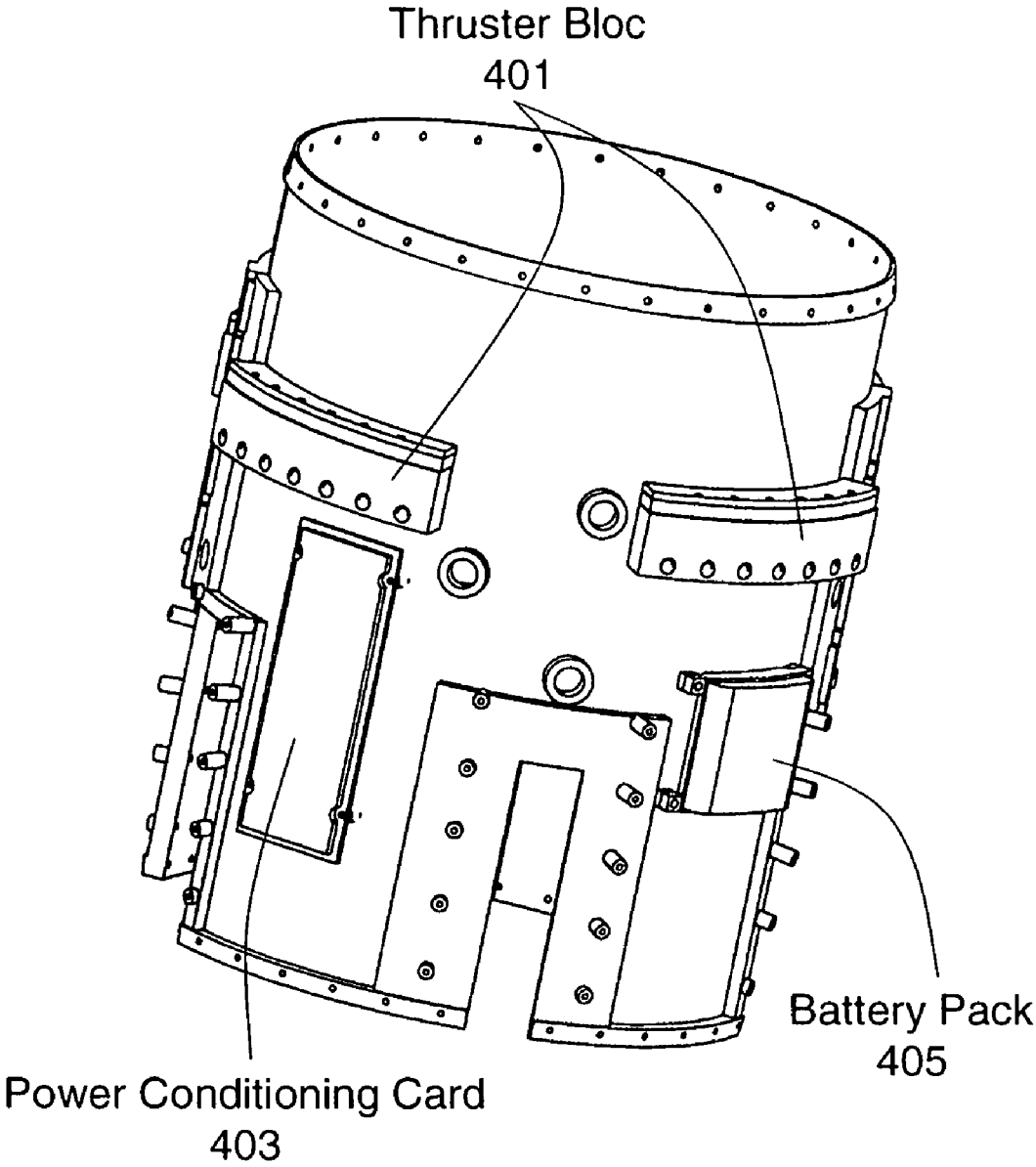
FIG. 4 depicts second hemispherical plate and the components thereon.

FIG. 4 shows the second hemispherical plate having thereon addition thrusters 401, second battery pack 405 and power-conditioning card 403. The securing of the components onto the first and second hemispherical plates can be achieved by using standard aerospace fasteners.

It is noted that the placement of any particular component on the first or second hemispherical plate is not critical, except that the multiple thrusters should be positioned in an orderly, pre-determined pattern such that they are distributed around the circumference of the rocket body and render symmetry to the two hemispherical plates with respect to the thrusters.

Each thruster has therein propellant material, an igniter and an exhaust port 309 through which the exhaust gas can escape. The thrusters can be grouped into blocs, each bloc having several (such as six to seven) thrusters.

The operation of the TCK begins upon first motion of rocket 100 when it is launched. Powered by battery packs 307 and 405, angular rate sensor 303 and computer 305 are triggered by the motion of the launch. The computer has therein data as to the normal parameters for the rocket at launch, such as the sustained acceleration (example: 35-80 g's for MLRS rocket) and the spin acceleration (example: from 0—prior to launch—to 4,000 degrees/second in five feet of travel). The angular rate sensor, in co-operation with the computer, verifies that the rocket motion is within the parameters for launch (i.e. that launch has actually occurred) and that the TCK operation can begin. The trajectory correction begins when the rocket is released from the launch tube after a per-determined time and distance interval from launch. The angular rate sensor continuously measures the pitch and yaw rates of the rocket in flight and inputs these rates into the computer.

Figure 6:
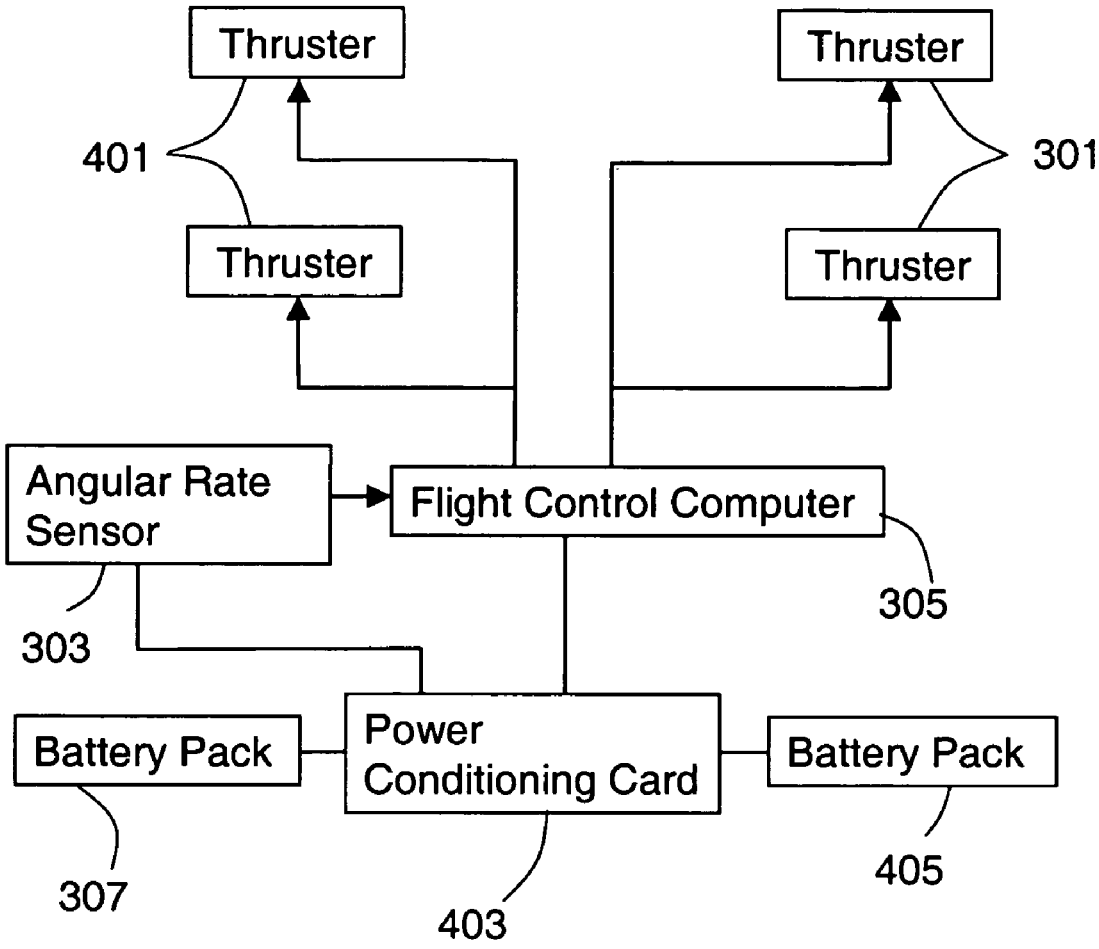
FIG. 6 is a functional diagram of the TCK.

A functional diagram of the TCK is presented in FIG. 6, wherein plain lines indicate electrical connections while arrow lines indicate data connections as well as electrical connections. Although only four thrusters are shown in the figure, there can, of course, be many more thrusters.

The computer uses the pitch and yaw rates to determine which particular thrusters should be fired and when so as to eliminate the measured pitch and yaw and transmits ignition commands to the selected thrusters at the appropriate time.

The thrusters respond to the ignition commands by igniting the propellant material and expelling the resulting exhaust gas through exhaust ports 309, thus steering the rocket in a given direction. The pitch and yaw rates are continuously measured and one or more thrusters ignited from time to time to eliminate the measured pitch and yaw until either all of the thrusters have been ignited or there is no more measured pitch and yaw, whichever occurs first.

A power-conditioning card can be used to maximize the function of the TCK. Card 403 is coupled, as depicted in FIG. 6, between the battery packs, angular rate sensor and the computer. The card takes the battery voltage, which can vary based on ambient temperature and the age of the batteries, and converts it to a clean, uniform, constant voltage and current supply for the sensor, the computer and the thrusters.

Although a particular embodiment and form of this invention has been illustrated, it is apparent that various modifications and embodiments of the invention may be made by those skilled in the art without departing from the scope and spirit of the foregoing disclosure.

One modification is equipping the TCK with a release mechanism to allow the TCK to fall away from the rocket when trajectory correction has been accomplished. This would reduce the weight of the rocket and remove any aerodynamic drag that may be caused by the TCK. One release mechanism is a means for pulling longitudinal bolts 501 free from the plate lugs 503 and compressed springs mounted on the underside of first and second hemispherical plates. When the bolts are released from the plate lugs, the springs eject the hemispherical plates away from each other as well as away from the rocket itself. Other similar modifications may be made to the TCK to enhance its performance.

Accordingly, the scope of the invention should be limited only by the claims appended hereto.

We claim:

1. A trajectory correction kit (TCK) to neutralize the perturbations in the trajectory of a rocket upon launch so as to enable the rocket to impact on a pre-selected target more accurately, said correction kit being externally mounted on the rocket, between the tailfins and the end of the body of the rocket, and comprising: a plurality of thrusters, said thrusters being deployed around the circumference of the rocket; a control computer coupled to said thrusters, said computer activating particular thrusters from time to time to effect pre-calculated trajectory correction; an angular rate sensor to sense the motion of the rocket and measure any pitch and yaw rates of the rocket in flight and input said rates to said control computer, said computer using said rates to calculate the trajectory correction required to eliminate said measured pitch and yaw; at least one battery pack to provide power to said control computer and angular rate sensor; a baseplate to support thereon said thrusters, rate sensor, computer and battery pack; and a means for mounting said correction kit onto the rocket.

2. A trajectory correction kit (TCK) to neutralize the perturbations in the trajectory of a rocket upon launch as set forth in claim 1, wherein said multiple thrusters each have therein propellant; a means to ignite said propellant and an exhaust port to release the resulting exhaust gas therethrough.

3. A TCK to neutralize the perturbations in the trajectory of a rocket as set forth in claim 2, wherein said baseplate comprises: a first hemispherical plate and a second hemispherical plate, said hemispherical plates joining together to form a first tubular unit, said first tubular unit being surroundingly mounted onto the rocket; and a means to secure said first unit on the rocket so as to enable said unit to remain fixedly attached to the body of the rocket.

4. A TCK to neutralize the perturbations in the trajectory of a rocket as set forth in claim 3, wherein said battery packs are two in number, one pack located on each of said hemispherical plates.

5. A TCK as set forth in claim 4, wherein said TCK further comprises: a power-conditioning card, said card being coupled between said battery, computer and sensor and converting the voltage from said battery to a constant voltage and current supply for use by said computer and sensor.

6. A TCK as set forth in claim 5, wherein said angular rate sensor continuously measures any pitch and yaw rates of the rocket during its flight.

7. A TCK as set forth in claim 6, wherein said TCK still further comprises: a protective aerodynamic cover, said cover cooperating with said baseplate to sandwich therebetween said battery packs, power-conditioning card, computer, sensor and thrusters.

8. A TCK as set forth in claim 7, wherein said protective cover comprises a third and a fourth hemispherical plates, said third and fourth hemispherical plates joining together to form a second tubular unit, said third hemispherical plate being further coupled to said first hemispherical plate while said fourth hemispherical plate is coupled to said second hemispherical plate.

9. A TCK as set forth in claim 8, wherein said plurality of thrusters are grouped into blocs of several thrusters each, said blocs being positioned around the circumference of the rocket body.

10. A TCK as set forth in claim 9, wherein said baseplate and protective cover are formed of aluminum, stainless steel or non-metallic material capable of withstanding high temperatures.

11. A trajectory correction kit (TCK) to neutralize the perturbations in the trajectory of a rocket upon launch so as to enable the rocket to impact on a pre-selected target more accurately, said correction kit comprising: an annular housing, said housing being clamped onto the rearward portion of the body of the rocket by passing the rear portion of the rocket through the central opening of said annular housing, said housing containing therein a plurality of thruster blocs; a control computer coupled to said thruster blocs; an angular rate sensor to sense the motion of the rocket and continuously measure any pitch and yaw rates of the rocket in flight and input said rates to said control computer, said computer using said rates to calculate the required trajectory correction so as to eliminate said measured pitch and yaw; at least one battery pack to provide power to said control computer and angular rate sensor; and a means for fixedly securing said housing onto the rocket.

12. A trajectory correction kit (TCK) as set forth in claim 11, wherein said thruster blocs are distributed such that they are positioned around the circumference of the rocket body.

13. A TCK as set forth in claim 12, wherein each said bloc comprises several individual thrusters, each individual thruster functioning independently of any other thruster.

14. A TCK as set forth in claim 13, wherein said thrusters are ignitable in response to ignition commands.

15. A TCK as set forth in claim 14, wherein said computer generates ignition commands corresponding to said calculated trajectory correction and inputs said commands to selected thrusters.

16. A TCK as set forth in claim 15, wherein said computer contains therein a means for determining the locations of any particular thrusters that are necessary to be ignited to achieve the elimination of said measured pitch and yaw.

17. A TCK as set forth in claim 16, wherein said housing further contains therein: a power-conditioning card, said card being coupled between said battery, computer and sensor and converting the voltage from said battery to a uniform, constant voltage and current supply for use by said computer, sensor and thrusters.

* * * * *